United States Patent [19]

Rogers et al.

[11] Patent Number: 5,019,175

[45] Date of Patent: May 28, 1991

[54] METHOD FOR THE DESTRUCTION OF HALOGENATED ORGANIC COMPOUNDS IN A CONTAMINATED MEDIUM

[75] Inventors: Charles J. Rogers; Alfred Kornel, both of Cincinnati; Harold L. Sparks, Fayetteville, all of Ohio

[73] Assignee: The United States of America as represented by the Administrator, Environmental Protection Agency, Washington, D.C.

[21] Appl. No.: 350,425

[22] Filed: May 11, 1989

[51] Int. Cl.[5] ..... B08B 7/00

[52] U.S. Cl. ..... 134/42; 208/262.5; 210/909; 252/581; 585/469; 585/538; 585/612; 585/641; 423/DIG. 20

[58] Field of Search ..... 208/262; 585/469; 210/909; 252/581; 134/42

[56] References Cited

U.S. PATENT DOCUMENTS

| | | | |
|---|---|---|---|
| 4,327,027 | 4/1982 | Howard et al. | 208/262 |
| 4,337,368 | 6/1982 | Pytlewski et al. | 208/262 |
| 4,351,718 | 9/1982 | Brunelle | 208/262 |
| 4,353,793 | 10/1982 | Brunelle | 208/262 |
| 4,400,552 | 8/1983 | Pytlewski et al. | 208/262 |
| 4,574,013 | 3/1986 | Peterson | 208/262 |
| 4,602,994 | 7/1986 | Pytlewski et al. | 208/262 |
| 4,663,027 | 5/1987 | Mendiratta et al. | 208/262 |
| 4,675,464 | 6/1987 | Rogers et al. | 208/262 |
| 4,685,220 | 8/1987 | Meenan et al. | 208/262 |
| 4,761,221 | 8/1988 | Rossi et al. | 208/262 |
| 4,792,407 | 12/1988 | Zeff et al. | 208/262 |
| 4,793,937 | 12/1988 | Meenan et al. | 208/262 |

FOREIGN PATENT DOCUMENTS

| | | | |
|---|---|---|---|
| 118858 | 8/1984 | European Pat. Off. | 208/262 |

OTHER PUBLICATIONS

Frank J. Iaconianni, Destruction of PCBs—Environmental Applications of Alkali Metal Polyethylene Glycolate Complexes, EPA/600/2-85/108, Franklin Research Center, Philadelphia, Pa. 19103 (Sep. 1985).

Kornel et al., "PCB Destruction: A Novel Dehalogenation Reagent", *Journal of Hazardous Materials,* 12 (1985), pp. 161-176.

*Chemical Abstracts,* vol. 82, No. 139620P (1975).

Iaconianni et al., *Destruction of PCB's—Environmental Applications of Alkali Metal Polyethylene Complexes,* National Technical Information Service, Sep. 1985.

*Primary Examiner*—Asok Pal

[57] ABSTRACT

A method for the destruction of halogenated organic compounds contained in a contaminated medium comprises adding an aqueous solution of polyethylene glycol to the contaminated medium in an amount to provide from about 0.1 to about 20 weight percent of polyethylene glycol, based on the weight of the contaminated medium. An alkali metal hydroxide is then added in an amount of from about 2 to about 20 weight percent, based on the weight of the contaminated medium. The medium is then heated to substantially dehydrate the medium and then further heated at a temperature between about 100° and 350° C. to effect destruction of the halogenated organic compounds. An acid is then added to the medium in an amount sufficient to neutralize the same.

16 Claims, No Drawings

METHOD FOR THE DESTRUCTION OF HALOGENATED ORGANIC COMPOUNDS IN A CONTAMINATED MEDIUM

FIELD OF THE INVENTION

The present invention relates to a method for the destruction of halogenated organic compounds contained in a contaminated medium. More particularly, the invention relates to a method for the destruction of halogenated organic compounds contained in a contaminated medium by use of an aqueous solution of polyethylene glycol, an alkali metal hydroxide, and an acid.

BACKGROUND OF THE INVENTION

The hazards to public health and the environment which are posed by a variety of synthetic halogenated organic compounds is well known. Compounds such as polychlorinated biphenyls (PCB's), dichlorodiphenyl trichloroethane (DDT), dieldrin, lindane and chlordane have been found to be persistent, environmentally toxic materials which require safe and efficient means of disposal PCB's pose a particularly serious disposal problem. Once widely used as dielectric fluid additives in electrical equipment such as transformers and capacitors because of their excellent insulating properties, the use of PCB's in many applications has been banned by the U.S. Environmental Protection Agency owing to their cumulative storage in the human body and extremely high toxicity. Thus, methods for the removal and/or destruction of halogenated organic compounds such as PCB's are required.

Various methods for the removal and/or the destruction or decomposion of halogenated organic compounds are known in the art. For example, the Peterson U.S. Pat. Nos. 4,447,541 and 4,574,013 disclose methods for decontaminating soil which is contaminated with halogenated organic compounds. The Peterson U.S. Pat. No. 4,447,541 discloses process in which a reagent mixture of an alkaline constituent and a sulfoxide catalyst (DMSO) are intimately mixed with soil contaminated with PCB's. The reagent mixture affects a desorption of the halogenated contaminants from the soil and subsequently dehalogenates the contaminants. However, this process is disadvantageous in that the kinetics are relatively slow and therefore reduction of the PCB concentration to an acceptable level requires extended time periods ranging from weeks to months, the soil must be completely dry for the destruction to take place, large quantities of the reagent are required, and the sulfoxide catalyst may potentially transport contaminants prior to their destruction. The Peterson U.S. Pat. No. 4,574,013 discloses a process wherein a heated slurry of contaminated soil is treated with a mixture of an alkaline constituent and a sulfoxide catalyst. However, this process is similarly disadvantageous in that the sulfoxide catalyst may transport contaminants into living systems, and the sulfoxide catalyst produces odorous compounds when heated to high temperatures and decomposes into combustible byproducts under elevated temperature conditions. This process is also disadvantageous in that it requires large amounts of reagents.

The Rogers et al U.S. Pat. No. 4,675,464 discloses a method for the chemical destruction of halogenated aliphatic hydrocarbons, and more particularly a method for the chemical destruction of ethylene dibromide. An alkali metal hydroxide is dissolved in an ethylene glycol and the resulting product is reacted with the halogenated hydrocarbon. Rogers et al further disclose that the reaction temperature should be maintained at 30° C. or less to maintain the reaction products in solution.

The Pytlewski et al U.S. Pat. No. 4,400,552 discloses a method for the decomposition of halogenated organic compounds which employs a reagent comprising the product of the reaction of an alkali metal hydroxide with a polyglycol or a polyglycol monoalkyl ether, and oxygen. The Pytlewski et al U.S. Pat. Nos. 4,337,368 and 4,602,994 disclose similar methods of decomposing halogenated organic compounds. However, these methods are disadvantageous in that excess amounts of the alkali metal hydroxide and polyglycol reagents are required in order to obtain a homogeneous distribution throughout the contaminated material, for example soil, sediment, sludge or the like, which is treated. Similarly, the Brunelle U.S. Pat. Nos. 4,351,718 and 4,353,793 disclose methods for removing polyhalogenated hydrocarbons from nonpolar organic solvent solutions by treating the contaminated solutions with a mixture of polyethylene glycol and an alkali metal hydroxide. These methods are similarly disadvantageous in that excess amounts of reagent are required. Additional methods for removing and/or destructing halogenated organic compounds contained in contaminated materials are disclosed in the Howard et al U.S. Pat. No. 4,327,027, the Mendiratta et al U.S. Pat. No. 4,663,027, the Meenan et al U.S. Pat. Nos. 4,685,220 and 4,793,937, the Rossi et al U.S. Pat. No. 4,761,221, the Zeff et al U.S. Pat. No. 4,792,407, European Patent Application No. 118,858, *Chemical Abstracts,* Vol. 82, No. 139620P (1975) and Kornel et al, *Journal of Hazardous Materials,* 12 (1985), pages 161–176. However, these and additional processes known in the art for the removal and/or destruction of halogenated organic compounds in contaminated materials are inadequate in view of the time required for acceptable levels of removal and/or destruction, the use of excessive amounts of various reagents, the production of toxic and/or combustible byproducts, and/or the failure to obtain desired removal and/or destruction levels. Thus, a need exists for additional methods for the removal and/or destruction of halogenated organic compounds in contaminated materials, which methods overcome the disadvantages of the prior art.

SUMMARY OF THE INVENTION

Accordingly, it is an object of the present invention to provide a new method for the destruction of halogenated organic compounds contained in a contaminated medium. It is a further object of the invention to provide a method for the destruction of halogenated organic compounds contained in a contaminated medium which employs significantly less amounts of reagent as compared with prior art methods. It is a further object of the invention to provide such a method wherein environmentally acceptable levels of halogenated organic compounds are achieved in the treated materials. It is a related object of the invention to provide such a method wherein the environmentally acceptable levels of contaminants in the materials are obtainable within a short period of time.

These and additional objects are achieved by the present invention which relates to methods for the destruction of halogenated organic compounds contained in a contaminated medium. The methods of the invention comprise the steps of adding an aqueous solution of polyethylene glycol to a contaminated medium containing the halogenated organic compounds. An alkali metal hydroxide is then added to the contaminated medium. Because the polyethylene glycol is added in an aqueous solution, water distributes the reagents throughout the medium and acts as a wetting agent. The contaminated medium is then heated at a temperature and for a time sufficient to substantially dehydrate the medium. Although the water is removed, the reagents are well distributed throughout the medium and are concentrated to a very reactive state. The medium is then further heated at a temperature between about 100° and 350° C. for a time sufficient to effect destruction of the halogenated organic compounds. Destruction of the halogenated compounds in the contaminated medium is more dependent on the presence of the alkali metal compound as the temperature increases within this range. Finally, an acid is added to the medium in an amount sufficient to neutralize the medium so that it may be returned to its original environment. Because the aqueous solution of polyethylene glycol is employed, the amounts of reagents which are required for the present methods are significantly reduced. Additionally, because the reagents are well distributed throughout the medium by the aqueous solution, a homogeneous destruction of the halogenated organic compounds is achieved. Moreover, because lower amounts of reagent are employed, recycling of excess reagents is not required.

These and additional objects and advantages will become more fully understood in view of the following detailed description.

DETAILED DESCRIPTION

The present invention comprises methods for the destuction of halogenated organic compounds contained in a contaminated medium. The contaminated medium may comprise soil, sludge, sediment or a liquid. The present methods are particularly adapted for use with soils, sludges and sediments. The methods are suitable for use with mediums which contain up to 100,000 ppm of halogenated organic compounds, aliphatic or aromatic, for example PCB's, or even higher levels of the halogenated organic compounds. The contaminated mediums which are suitable for use in the invention may also include an absorbent or adsorbent, for example spent activated carbon or the like.

Generally, the methods of the invention comprise adding an aqueous solution of polyethylene glycol to the contaminated medium, adding an alkali metal hydroxide to the contaminated medium, heating the contaminated medium to obtain substantial dehydration, and further heating the medium to destruct the halogenated organic compounds. The water included in the polyethylene glycol solution distributes the reagents throughout the contaminated medium. In the final step, the medium is treated with an acid to provide a neutral pH so that the medium may be safely returned to its original environmental if desired.

The aqueous solution of polyethylene glycol is added to the contaminated medium in an amount to provide from about 0.1 to about 20 weight percent polyethylene glycol, based on the weight of the contaminated medium. Additionally, the aqueous solution contains sufficient water to effect homogeneous distribution of the polyethylene glycol and the subsequently added alkali metal hydroxide throughout the contaminated medium. While the particular amount of the aqueous solution of polyethylene glycol which is added to the contaminated medium generally depends on the level of halogenated organic compounds contained in the medium, in a preferred embodiment, the aqueous solution of polyethylene glycol is added in an amount sufficient to provide from about 1 to about 5 weight percent polyethylene glycol, based on the weight of the contaminated medium.

Various polyethylene glycol materials are known in the art and are suitable for use in the invention. Preferred polyethylene glycols suitable for use in the invention have an average molecular weight, Mw, from about 120 to 1,000 Daltons. It is noted that throughout the present specification and claims the term "polyethylene glycol" includes such compounds and/or the monomethyl ethers.

The alkali metal hydroxide is added to the contaminated medium in an amount of from about 2 to about 20 weight percent, again based on the weight of the contaminated medium. As with the aqueous solution of polethylene glycol, the specific amount of alkali metal hydroxide which is required is dependent on the level of halogenated organic compounds contained in the contaminated medium. In a preferred embodiment, the alkali metal hydroxide is added in an amount of from about 2 to about 12 weight percent based on the weight of the contaminated medium. The metal which forms the hydroxide reagent may be any of the alkali metals, or mixtures thereof. Preferred alkali metals include lithium, sodium and potassium with sodium and potassium being particularly preferred.

After addition of the aqueous solution of polyethylene glycol and the alkali metal hydroxide, the contaminated medium is heated at a temperature and for a time sufficient to substantially dehydrate the medium, i.e., to remove 75 weight percent or more of the water contained therein. As will be demonstrated in the Examples, this heating step may be performed at atmospheric pressure or at reduced or elevated pressures if so desired. As noted above, the water which is included in the aqueous solution of polyethylene glycol allows homogeneous distribution of both the polyethylene glycol and the alkali metal hydroxide throughout the medium and acts as a wetting agent and a penetrant. When the water is removed from the medium during the dehydration step, the reagents are then concentrated to a very reactive state yet are well distributed throughout the contaminated medium.

After dehydration, the medium is further heated at a temperature between about 100° and 350° C. for a time sufficient to effect destruction of the halogenated organic compounds. More preferably, the medium is heated at a temperature between about 125° C. and 350° C. to effect destruction of the halogenated organic compounds. In this stage, a hydrogen free radical source is formed by reaction of the polyethylene glycol and the alkali metal hydroxide, particularly at temperatures of 250°-350° C., preferably of 330° to 350° C. as shown in Examples 3 and 4. The hydrogen free radical source reacts with the halogenated organic compounds. Again, this step may be conducted at atmospheric pressure or at reduced or elevated pressures. The time required for destruction of the halogenated organic compounds similarly depends upon the level of such compounds in the contaminated material. Generally however, a time period of from about 0.5 to about 4 hours is sufficient.

Finally, the medium is treated with an acid for neutralization. Preferably, the acid is added in amount sufficient to provide the medium with a pH value of from about 7 to about 9. Suitable acids for use in the invention comprise sulfuric acid, phosphoric acid, hydrochloric acid and nitric acid. With the exception of hydrochloric acid, these acids not only neutralize the medium but also provide valuable soil fertilizers, for example $Na_2SO_4$ or sodium sulfate from use of sulfuric acid, $NaH_2PO_4$, $Na_2HPO_4$, $Na_3PO_4$ or sodium phosphates from the use of phosphoric acid, and $NaNO_3$ or sodium nitrate from the use of nitric acid, given that NaOH is employed as the alkali metal hydroxide. If KOH is used, then the potassium salts are produced.

Generally, oxygen is not a detriment to the methods of the present invention and therefore air need not be excluded. When applied to the decontamination of hydrocarbon fluids, either aliphatic or aromatic, it may be desirable to exclude air in order to prevent ignition of the hydrocarbon. Thus, the present methods may be performed either in the presence or the absence of an oxygen-containing atmosphere.

Because the present methods employ relatively small amounts of both the polyethylene glycol and alkali metal hydroxide reagents, there is no need to recover excess reagents for reuse. Moreover, because the present invention employs water to wet the contaminated medium and to distribute the polyethylene glycol and alkali metal hydroxide reagents therein, the present methods are significantly less costly than prior art methods which employ polyethylene glycol alone to wet the contaminated medium. The present methods may be performed in either a continuous or a batch system, and, if desired, all steps may be performed in a single reactor. As will be demonstrated in the Examples, the methods of the invention reduce the halogenated organic compounds, particularly haloaromatic compounds, to non-detectable levels. Additionally, the products of the present methods are non-mutagenic, non-teratogenic and non-toxic to life forms.

The methods of the present invention are demonstrated in the following Examples:

EXAMPLE 1

This example demonstrates the application of the method according to the present invention to a contaminated material comprising PCB contaminated soil from Guam U.S.A. The soil contained approximately 2,000 to 2,500 ppm of a PCB having the commercial designation Aroclor 1260. One hundred grams of the contaminated soil was placed in a round bottom flask provided with a stirrer and a distillation head condenser and receiver. To the contamined soil was added 25 ml of water containing 5 grams of PEG-400 (a polyethylene glycol having an average molecular weight of 400 Daltons). The resulting slurry was thoroughly mixed for about five minutes after which 12.5 grams of 98 percent sodium hydroxide was added. Mixing was resumed and heating of the reaction was commenced. Water was distilled off over a 1-½ to 2-½ hour period, after which the contents of the reactor were further heated to a temperature between 135° and 155° C. for four hours. After heating, the reactor was cooled and the contents were neutralized by acid addition to have a pH of between 7 and 9. The resulting product was subjected to PCB analysis which revealed that the residual PCB's remaining in the soil were less than 2 ppm.

EXAMPLE 2

This example further demonstrates the methods according to the present invention. One hundred grams of the PCB-containing soil described in Example 1 were placed in the same type of reactor as described in Example 1. To the mixture was added 25 ml of water containing 5 grams of PEG-400. The mixture was stirred for approximately five minutes and 12.5 grams of 98 percent sodium hydroxide was added. Mixing was resumed and heating was initiated. A vacuum of about 29 inches of Hg was drawn on the reactor and water was distilled off at a temperature of from 35 to 85° C. After the water had been removed, in about 0.5 to 1 hour, the reactor contents rose in temperature to about 145° to 350° C. within 10 to 30 minutes. A temperature of 145° to 350° C. was maintained for 1 to 1.5 hours, after which the reactor was cooled. The treated soil was analyzed for residual PCB's as in Example 1. Again, the analysis showed a residual PCB level of less than 2 ppm.

EXAMPLE 3

This example demonstrates the application of the method according to the present invention to a contaminated material comprising PCB-contaminated soil from Mechanicsburg, Pa. The soil had been spiked with pentachlorophenol to a level of 10.25 mg per 10 grams of soil. In a 100 ml round-bottom flask, 20.5 grams of the soil was placed, after which 5 ml of water containing 0.20 ml of PEG-400 and 0.20 ml of tetraethyleneglycol (TEG) were added. The contents of the flask were thoroughly mixed. After mixing, 2.0 grams of sodium hydroxide pellets were added. The flask was equipped with a distillation head, condensor and receiving flask, and a thermoprobe was inserted through the distillation head so that the probe tip rested in the soil slurry. The flask temperature was raised by means of a heating mantle to approximately 333°-350° C. and was maintained within this temperature range for 5 hours. After cooling, 11 grams of residual soil were removed from the reactor and adjusted to a pH of 2, with dilute hydrochloric acid (HCl). This material was then extracted, and the concentrated extract was subjected to analysis by Gas chromatography-Mass spectrometry (GC-MS). No pentachlorophenol was detected, nor were any PCB congeners detected in this treated soil extract. Further, the glassware, including the distillation head and condensor, were rinsed with acetone into the receiving flask which contained the distilled and condensed water. This water acetone mixture was adjusted to a pH of 2 with HCl and extracted into hexane. The hexane was concentrated to 10 ml and analyzed by GC-MS as in the case of the soil extract. Again, no PCP was detected, nor any of the PCP break down products, which would be expected if no reaction had occurred. Only traces of PCB congeners were detected in this distilled condensed material.

EXAMPLE 4

This example further demonstrates the application of the present methods for destruction of halogenated organic compounds. To an additional sample of the Mechanicsburg, Pa. soil as described in Example 3, was added Aroclor 1242 at 1.5 mg per 10 grams of soil, and Dieldrin at 1.75 mg per 10 grams of soil. Twenty grams of the resulting spiked-contaminated soil were placed into the same reaction equipment as described in Example 3, together with 5 ml of water containing 0.20 ml of TEG and 0.20 ml of PEG-400. After mixing, 2.4 grams of sodium hydroxide in pellet form were added and the reaction equipment was set up as in Example 3. The temperature was raised to and maintained between 330°-345° C. for 4 hours. After cooling, the soil, as well as any condensate, was extracted and analyzed via GC-MS. Analysis of the soil revealed that no Lindane, Dieldrin, or PCB's were remaining in the treated soil sample. Analysis of the distillate revealed no Lindane or Dieldrin and only traces of PCB congeners.

The preceding examples are set forth to illustrate specific embodiments of the invention, and are not intended to limit the scope of the methods of the present invention. Additional embodiments and advantages within the scope of the claimed invention will be apparent to one of ordinary skill in the art.

What is claimed is:

1. A method for the destruction of halogenated organic compounds contained in a contaminated medium, comprising (a) adding an aqueous solution of polyethylene glycol to a contaminated medium containing halogenated organic compounds, the aqueous solution of polyethylene glycol being added in an amount to provide from about 0.1 to about 20 weight percent polyethylene glycol, based on the weight of the contaminated medium;

(b) adding an alkali metal hydroxide to the contaminated medium in an amount of from about 2 to about 20 weight percent based on the weight of the contaminated medium;

(c) heating the contaminated medium at a temperature and for a time sufficient to remove at least 75 weight percent of the water from the medium;

(d) further heating the medium at a temperature between about 250° C. and 350° C. for a time sufficient to effect destruction of the halogenated organic compounds; and (e) adding an acid to the medium in an amount sufficient to provide the medium with a pH of from about 7 to about 9.

2. A method as defined by claim 1, wherein the polyethylene glycol has an average molecular weight of from about 120 to 1,000 Daltons.

3. A method as defined by claim 1, wherein the aqueous solution of polyethylene glycol is added in an amount to provide from about 1 to about 5 weight percent polyethylene glycol, based on the weight of the contaminated medium.

4. A method as defined by claim 1 wherein the alkali metal hydroxide is selected from the group consisting of sodium hydroxide and potassium hydroxide.

5. A method as defined by claim 1, wherein the alkali metal hydroxide is added in an amount of from about 2 to about 12 weight percent based on the weight of the contaminated medium.

6. A method as defined by claim 1, wherein the acid which is added to the medium to provide a pH of from 7 to about 9 is selected from the group consisting of sulfuric acid, phosphoric acid, hydrochloric acid and nitric acid.

7. A method as defined by claim 1, wherein the contaminated medium comprises soil.

8. A method as defined by claim 1, wherein the contaminated medium comprises sludge.

9. A method as defined by claim 1, wherein the contaminated medium comprises sediment.

10. A method as defined by claim 1, wherein the contaminated medium includes an absorbent comprising spent activated carbon.

11. A method as defined by claim 1, wherein the contaminated medium comprises a liquid.

12. A method as defined by claim 1, wherein the contaminated medium contains up to 100,000 ppm of halogenated organic compounds.

13. A method as defined by claim 1, wherein the medium which results from the acid addition step is returned to its original environment.

14. A method for the destruction of halogenated organic compounds contained in a contaminated medium, comprising (a) providing a contaminated medium comprising soil, sludge or sediment and containing at least one halogenated organic compound contaminant therein;

(b) adding an aqueous solution of polyethylene glycol to the contaminated medium, the aqueous solution of polyethylene glycol being added in an amount to provide from about 0.1 to about 5 weight percent polyethylene glycol, based on the weight of the contaminated medium;

(c) adding an alkali metal hydroxide to the contaminated medium in an amount of from about 2 to about 12 weight percent based on the weight of the contaminated medium;

(d) heating the contaminated medium at a temperature and for a time sufficient to remove at least 75 weight percent of the water in the medium;

(e) further heating the medium at a temperature between about 250° C. and 350° C. for a time sufficient to effect destruction of the halogenated organic compounds; and (f) adding an acid to the medium in an amount sufficient to provide the medium with a pH of from about 7 to about 9.

15. A method for the destruction of halogenated organic compounds contained in a contaminated medium, comprising (a) adding an aqueous solution of polyethylene glycol to a contaminated medium containing halogenated organic compounds, the aqueous solution of polyethylene glycol being added in an amount to provide from about 0.1 to about 20 weight percent polyethylene glycol, based on the weight of the contaminated medium;

(b) adding an alkali metal hydroxide to the contaminated medium in an amount of from about 2 to about 20 weight percent based on the weight of the contaminated medium;

(c) heating the contaminated medium at a temperature and for a time sufficient to remove at least 75 weight percent of the water from the medium;

(d) further heating the medium at a temperature between about 330° C. and 350° C. for a time sufficient to effect destruction of the halogenated organic compounds; and (e) adding an acid to the medium in an amount sufficient to provide the medium with a pH of from about 7 to about 9.

16. A method for the destruction of halogenated organic compounds contained in a contaminated medium, comprising (a) providing a contaminated medium comprising soil, sludge or sediment and containing at least one halogenated organic compound contaminant therein;

(b) adding an aqueous solution of polyethylene glycol to the contaminated medium, the aqueous solution of polyethylene glycol being added in an amount to provide from about 0.1 to about 5 weight percent polyethylene glycol, based on the weight of the contaminated medium;

(c) adding an alkali metal hydroxide to the contaminated medium in an amount of from about 2 to about 12 weight percent based on the weight of the contaminated medium;

(d) heating the contaminated medium at a temperature and for a time sufficient to remove at least 75 weight percent of the water in the medium;

(e) further heating the medium at a temperature between about 330° C. and 350° C. for a time sufficient to effect destruction of the halogenated organic compounds; and (f) adding an acid to the medium in an amount sufficient to provide the medium with a pH of from about 7 to about 9.

* * * * *